United States Patent [19]

Ishihara

[11] 4,329,947

[45] May 18, 1982

[54] CYLINDER BLOCK STRUCTURE OF AN INTERNAL COMBUSTION ENGINE

[75] Inventor: Akira Ishihara, Oyama, Japan

[73] Assignee: Kabushiki Kaisha Komatsu Seisakusho, Tokyo, Japan

[21] Appl. No.: 82,086

[22] Filed: Oct. 5, 1979

[30] Foreign Application Priority Data

Oct. 5, 1978 [JP] Japan ..... 53-136038[U]

[51] Int. Cl.[3] ..... F02F 7/00

[52] U.S. Cl. ..... 123/41.74; 123/193 C; 123/195 H

[58] Field of Search ..... 123/41.72, 41.74, 41.78, 123/41.76, 41.81, 41.83, 41.84, 658, 195 R, 195 H, 193 R, 193 C, 193 CH, 193 CP

[56] References Cited

U.S. PATENT DOCUMENTS

| | | | |
|---|---|---|---|
| 1,764,739 | 6/1930 | Meyer | 123/41.84 |
| 2,019,558 | 11/1935 | Brush | 123/195 H |
| 2,126,089 | 8/1938 | Brown | 123/193 C |
| 3,086,505 | 4/1963 | Bovard | 123/41.84 |
| 3,528,397 | 9/1970 | Seifert | 123/41.72 |

*Primary Examiner*—Craig R. Feinberg
*Attorney, Agent, or Firm*—Armstrong, Nikaido, Marmelstein & Kubovcik

[57] ABSTRACT

A cylinder block structure of an internal combustion engine comprising a plurality of struts for interconnecting a water jacket wall and an outer wall of the cylinder block, each strut being provided between adjacent cylinder liners and an approximately intermediate the depth of a tappet chamber where the maximum vibration is likely to occur when the engine is in operation.

3 Claims, 4 Drawing Figures

CYLINDER BLOCK STRUCTURE OF AN INTERNAL COMBUSTION ENGINE

BACKGROUND OF THE INVENTION

This invention relates to a cylinder block structure of an internal combustion engine.

An internal combustion engine generally has a camshaft and a plurality of pistons reciprocally mounted in respective cylinder liners. Rotation of the camshaft generates shocks or impacts on a camshaft bearings and reciprocal movement of the pistons causes shocks on the cylinder liners. These shocks are transmitted to a wall of a cam and tappet chamber to cause a vibration and to generate a noise therefrom.

SUMMARY OF THE INVENTION

It is therefore an object of the present invention to provide a cylinder block structure of an internal combustion engine which is capable of reducing vibrations of and noises from a wall of a tappet chamber.

In accordance with an aspect of the present invention, there is provided a cylinder block structure of an internal combustion engine comprising an outer wall of the cylinder block, a water jacket wall formed integrally with said outer wall, the outer wall of said cylinder block and said water jacket wall forming a tappet chamber therebetween, a plurality of cylinder liners disposed within said water jacket wall, and a plurality of strut means for connecting said water jacket wall with the outer wall of said cylinder block, each strut means being provided between said adjacent cylinder liners and an approximately intermediate the depth of the tappet chamber where the maximum vibration is likely to occur when the engine is in operation.

The above and other objects, features and advantages of the present invention will be readily apparent from the following description taken in conjunction with the accompanying drawings.

DETAILED DESCRIPTION OF THE INVENTION

Figure 1:
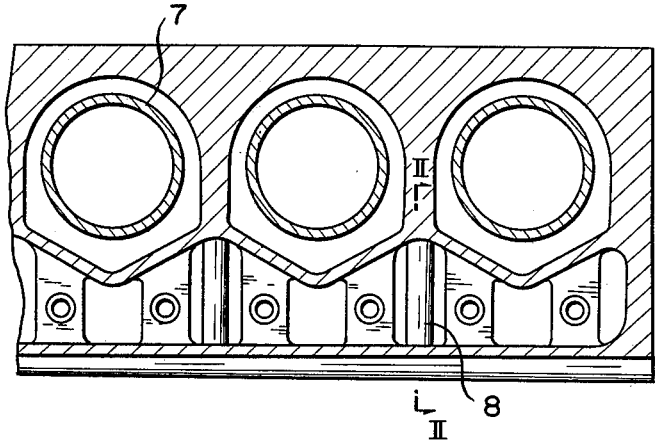
FIG. 1 is a schematical cross-sectional view of a cylinder block structure according to the present invention.
Figure 2:
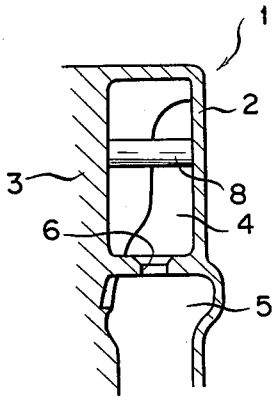
FIG. 2 is a cross-sectional view taken along the line II—II of FIG. 1.

The present invention will now be described with reference to the accompanying drawings. Reference numeral 1 denotes a cylinder block, 2 an outer wall of the cylinder block 1 and 3 a water jacket wall which is integrally formed with the outer wall 2 by casting. Formed between the outer wall 2 and the water jacket wall 3 is a tappet chamber 4 and a cam chamber 5 which is communicated with the tappet chamber 4 through an opening 6. Disposed within the water jacket wall 3 are a plurality of cylinder liners 7 in which respective pistons (not shown) are mounted for reciprocal movement.

A liquid coolant is filled in a space between the water jacket wall 3 and the cylinder liners 7.

According to the novel feature of the invention, a plurality of struts 8 are provided for interconnecting the outer wall 2 and the water jacket wall 3. In order to reduce vibrations occuring to the walls 2 and 3, connecting points of the struts 8 with the walls 2 and 3 must be carefully selected. Therefore, each strut 8 is positioned between adjacent pairs of cylinder liners 7 and approximately half the depth of the tappet chamber 4. The struts 8 are preferably made of a material whose vibration reducing ability is superior to that of the cylinder block 1. However, for practical application same material may be used for the both cylinder block 1 and struts 8. The struts 8 can take a form of bolt and nut combination, but preferably the struts 8 are integrally formed with the cylinder block 1 by casting.

Figure 3:
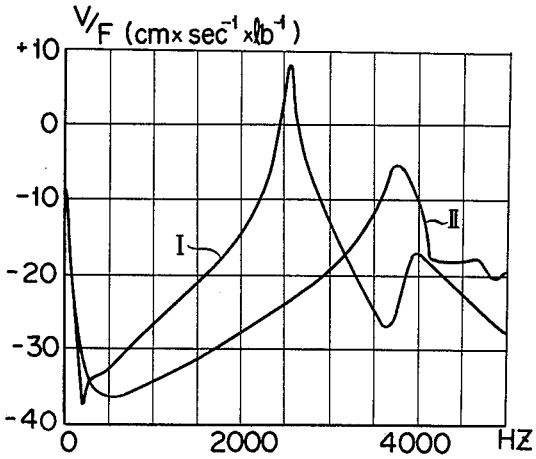
FIG. 3 is a graph showing natural vibration characteristics of cylinder block structures wherein a conventional cylinder block structure is represented by line I and a cylinder block structure according to the present invention is shown by line II.

Referring to FIG. 3, it can be seen that the number of natural vibrations of the cylinder block employed shifts from 2600 Hz of a conventional type to 3750 Hz of the present invention and vibration mobility V/F between the above frequencies declines 13 dB.

Figure 4:
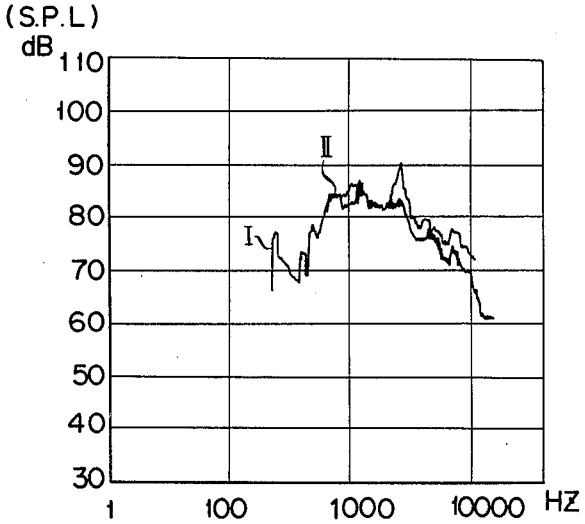
FIG. 4 is a graph showing difference in noise level between a conventional cylinder block structure I and that of the present invention II.

Referring to FIG. 4 showing a noise level comparison between a conventional device and the present invention, it can be observed that noise level declines about 7 dB in the central frequency band. Although from FIG. 4 alone, it is hard to tell what the central frequency band quated about is, this is defined by experiments between 2600 Hz to 2754 Hz.

Peak point of line I shows the frequency of 2754 Hz and a step slightly leftwards from the peak point represents the frequency of 2600 Hz.

According to the present invention, since a plurality of struts 8 are provided between the outer wall 2 of the cylinder block 1 and the water jacket wall 3 for interconnecting the same, it is possible to reduce vibrations occuring to the tappet chamber wall which is formed by the outer wall 2 and the water jacket wall 3 as well as the generation of noise therefrom.

What I claim is:

1. In a cylinder block structure of an internal combustion engine including an outer wall of said cylinder block, a water jacket wall formed integrally with said outer wall and having portions intermediate the top and bottom of said cylinder block extending in spaced relation to said outer wall, the outer wall of said cylinder block and said intermediate portions of said water jacket wall forming a tappet chamber therebetween with a depth extending from the top of the cylinder block to a wall containing a tappet seat, and a plurality of cylinder liners disposed with said water jacket wall, the improvement for the reduction of noise and vibrations in the walls of said tappet chamber comprising: a plurality of solid substantially cylindrically-shaped strut means in the tappet chamber extending between the water jacket wall and connecting with surfaces of the outer wall of said cylinder block, each solid strut means being provided between adjacent cylinder liners and disposed approximately at half the depth of the tappet chamber where maximum vibration tends to occur when the engine is in operation, whereby noise and vibrations of the cylinder block are significantly reduced.

2. A cylinder block structure of an internal combustion engine as set forth in claim 1 wherein said plurality of strut means comprise a material whose vibration reducing ability is superior to that of the cylinder block.

3. A cylinder block structure of an internal combustion engine as set forth in claim 1 wherein said plurality of strut means are formed integrally with said cylinder block by casting.

* * * * *